US005597775A

United States Patent [19]

Martin et al.

[11] Patent Number: 5,597,775

[45] Date of Patent: Jan. 28, 1997

[54] DYE-RECEIVER SUBBING LAYER FOR THERMAL DYE TRANSFER

[75] Inventors: Thomas W. Martin, Rochester; Ronald S. King, Fairport, both of N.Y.

[73] Assignee: Eastman Kodak Company, Rochester, N.Y.

[21] Appl. No.: 586,568

[22] Filed: Jan. 16, 1996

[51] Int. Cl.[6] ..... B41M 5/035; B41M 5/38

[52] U.S. Cl. ..... 503/227; 428/195; 428/447; 428/913; 428/914

[58] Field of Search ..... 8/471; 428/195, 428/447, 913, 914; 503/227

[56] References Cited

U.S. PATENT DOCUMENTS

| | | | |
|---|---|---|---|
| 4,965,241 | 10/1990 | Henzel et al. | 503/227 |
| 5,384,304 | 1/1995 | Kung et al. | 503/227 |

OTHER PUBLICATIONS

USSN 08/569,486 filed Dec. 8, 1995 of Martin et al.

*Primary Examiner*—B. Hamilton Hess
*Attorney, Agent, or Firm*—Harold E. Cole

[57] ABSTRACT

Dye-receiving element for thermal dye transfer comprising a polyolefin-coated substrate or a polyolefin substrate having thereon, in order, a subbing layer and a dye image-receiving layer, and wherein the subbing layer comprises a polyolefin-coated support or a polyolefin support having thereon, in order, a subbing layer and a dye image-receiving layer, wherein the subbing layer comprises a colored reaction product of a mixture of a) an aminofunctional organo-oxysilane, and b) a hydrophobic organo-oxysilane;

the subbing layer also containing a mixture of brown and black colorants, the brown colorant being present in an amount of about 0.0007 to about 0.015 g/m$^2$ and the black colorant being present in an amount of about 0.004 to about 0.007 g/m$^2$, and the ratio of black to brown colorant being about 3.5:1 to 6.5:1; and the subbing layer also containing at least 0.2 wt. % of a water-soluble, cellulose derivative.

20 Claims, No Drawings

DYE-RECEIVER SUBBING LAYER FOR THERMAL DYE TRANSFER

This invention relates to a dye-receiving dement for thermal dye transfer which is used for color proofing, and more particularly, to the use of a subbing layer comprising a colored reaction product of a mixture of two organosilane materials between the substrate and a polymeric dye-receiving layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Various grades of color proofing papers are commercially available for use in pre-press color proofing runs to test the inks which are to be used in the press run. These papers are conventionally grouped into two types: commercial grade and publication grade papers which differ only in their colorimetric properties. For example, a commercial grade paper may have a lightness (L*) value of about 95.7, a yellow-blue value (a*) of about-0.4, and a red-green (b*) value of about 2.5 as measured on a Gretag SPM 50 colorimetry tester with the paper backed by black. A commercially available, publication grade, pre-press printing paper such as "Contract CNPR" (Eastman Kodak Company), on the other hand, may have corresponding values of L* about 88.4, a* about 0.7, and b* about 3.7.

U.S. Pat. No. 5,384,304 relates to the use of a subbing layer for dye-receiving elements comprising a reaction product of a mixture of two organosilane materials. It would be desirable to modify this subbing layer so that one paper stock could be used for both grades of receiver elements used in color proofing papers as described above. This would maximize productivity and facilitate ease of manufacture.

U.S. Ser. No. 08/569,486, filed Dec. 8, 1995, of Martin et at. discloses a thermal proofing receiver which uses a colored subbing layer formulation which provides colorimetric characteristics approaching that of a publication grade proofing paper. However, there is a problem with this paper in that unacceptable mottle and minimum density (Drain) variability may occur. It is an object of this invention to provide a thermal proofing receiver which uses a colored subbing layer formulation which provides colorimetric characteristics approaching those of a publication grade proofing paper, and which has superior colorimetric and uniformity characteristics.

These and other objects are achieved in accordance with the present invention which comprises a dye-receiving element for thermal dye transfer comprising a polyolefin-coated support or a polyolefin support having thereon, in order, a subbing layer and a dye image-receiving layer, wherein the subbing layer comprises a colored reaction product of a mixture of a) an aminofunctional organo-oxysilane, and b) a hydrophobic organo-oxysilane;

the subbing layer also containing a mixture of brown and black colorants, the brown colorant being present in an amount of about 0.0007 to about 0.015 g/m$^2$ and the black colorant being present in an amount of about 0.004 to about 0.007 g/m$^2$, and the ratio of black to brown colorant being about 3.5:1 to 6.5:1; and the subbing layer also containing at least 0.2 wt. % of a water-soluble, cellulose derivative.

By use of a colored subbing layer according to the invention, it has been found that it is possible to adjust the colorimetric characteristics of a commercial grade proofing paper so that they may approach those of a publication grade proofing paper without mottle or loss of print uniformity.

The aminofunctional organo-oxysilane useful in the invention is more fully described in U.S. Pat. No. 4,965,241, the disclosure of which is hereby incorporated by reference.

For the purpose of this invention, "organo-oxysilane" is defined as $X_{4-m}Si(OR)_m$, where X and R represent substituted or unsubstituted hydrocarbon substituents and m equals 1, 2 or 3. "Aminofunctional organo-oxysilane" is defined as an organo-oxysilane as set forth above wherein at least one X substituent contains a terminal or internal amine function. Such compounds can be prepared by conventional techniques and are commercially available.

Specific examples of such aminofunctional organo-oxysilanes are $H_2N(CH_2)_3Si(OC_2HS)_3$ (3-aminopropyl triethoxysilane, commercially available as product 11,339-5 of Aldrich Chem. Co.), $H_2N(CH_2)_2NH(CH_2)_3Si(OCH_3)_3$ (N-(2-aminoethyl)-3-aminopropyl-trimethoxysilane, commercially available as product Z-6020 of Dow Coming Co.), $H_2N(CH_2)_2NH(CH_2)_2NH(CH_2)_3Si(OCH_3)_3$ (trimethoxysilylpropyl-diethylenetriamine, commercially available as product T-29 10 of Petrarch Systems, Inc.), Prosil 221® 3-aminopropyl triethoxysilane (PCR Inc.), and Prosil 3128® N-(2-aminoethyl)-3-aminopropyl-trimethoxysilane (PCR Inc.).

In a further preferred embodiment of the invention, the aminofunctional organo-oxysilane used in the invention has the following formula:

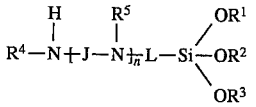

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms, such as —$CH_2$—, —$CH(CH_3)$—, —$C_6H_4$— or combinations thereof; and n is 0 or a positive integer up to 6.

In a preferred embodiment, J and L are —$C_xH_{2x}$—linking moieties of from 1 to 10 carbon atoms, $R^1$, $R^2$ and $R^3$ are each alkyl groups and n is 0, 1 or 2.

The hydrophobic organo-oxysilanes useful in the invention are formed from a non-substituted alkyl- or aryl-organo-oxysilane. For the purpose of this invention, "hydrophobic organo-oxysilane" is defined as $Y_{4-m}Si(OR)_m$, where Y represents a non-substituted alkyl or aryl group, R represents a substituted or unsubstituted hydrocarbon substituents and m equals 1, 2 or 3. Such silanes can be prepared by conventional techniques and are commercially available. In a preferred embodiment of the invention, the hydrophobic organo-oxysilane also contains an epoxy-terminated organo-oxysilane.

In a further preferred embodiment of the invention, the hydrophobic organo-oxysilane used in the invention has the following formula:

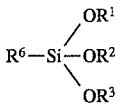

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

Specific examples of such hydrophobic organo-oxysilanes are Prosil 178® isobutyl triethoxysilane (PCR Inc.) and Prosil 9202® N-octyl triethoxysilane (PCR Inc.). Prosil 2210® (PCR Inc.) is an example of an epoxy-terminated organo-oxysilane blended with a hydrophobic, organo-oxysilane.

When the two silanes described above are mixed together to form the subbing layer reaction product, it is believed that they will react with each other to form silicon-oxide bonds. It is believed that the reaction product will also form physical bonds with the polymeric dye image-receiving layer and chemical bonds with the polyolefin layer.

The ratios of the two silanes used in the subbing layer may vary widely. For example, good results have been obtained with ratios of from 3:1 to 1:3. In a preferred embodiment, a ratio of 1:1 is used.

The brown and black colorants used in the invention may be either dyes or pigments. For example, the following black dyes may be employed:

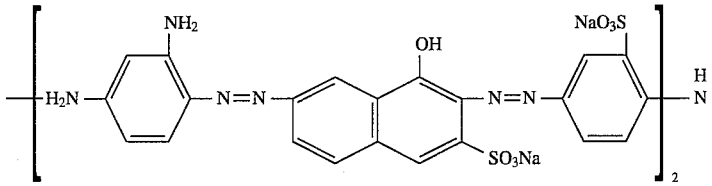

Benzo Black A250

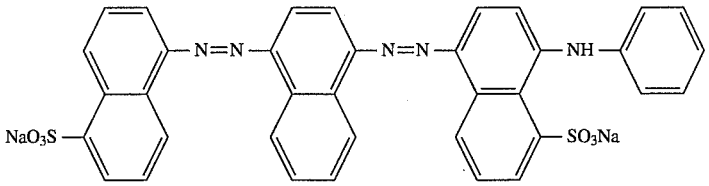

Sulfone Cyanine Black BB

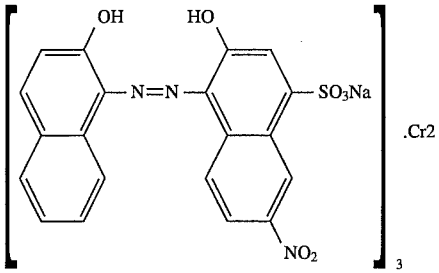

Palatine Fast Black Wan

The following brown dyes may be employed:

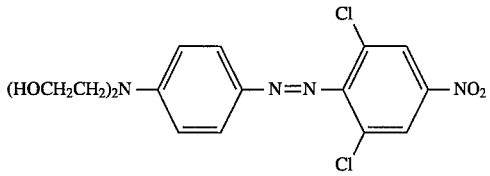

Eastone Brown 2R ®

-continued

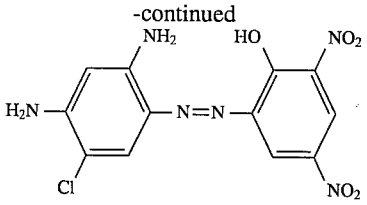

Metachrome Brown BC

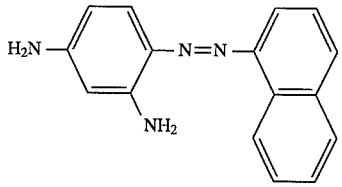

Fat Brown RR

The following black pigment may be employed:

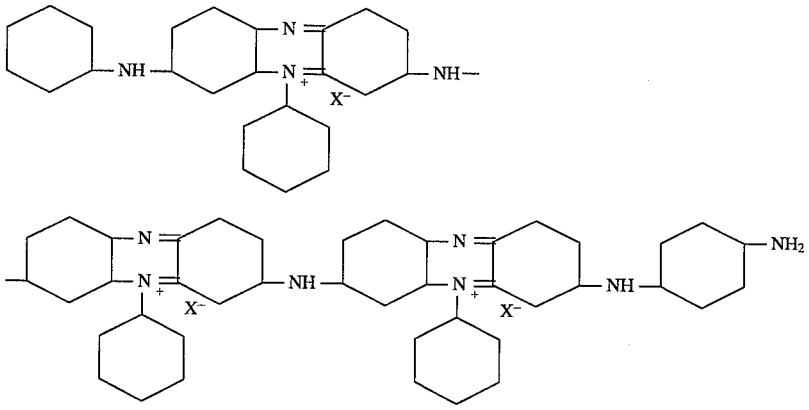

(X = acid radical)
Aniline Black

The following brown pigment may be employed:

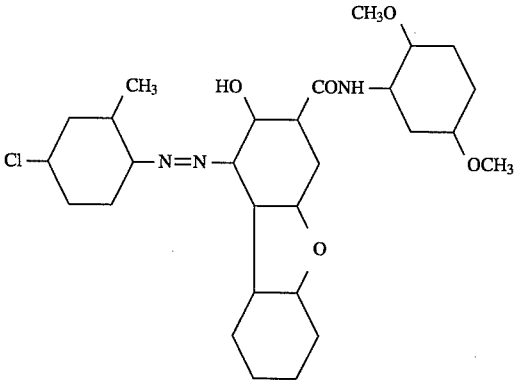

Permanent Brown B

Any water-soluble derivative of cellulose may be used in the subbing layer employed in the invention. For example, there may be used hydroxypropyl cellulose, hydroxypropyl methyl cellulose, hydroxybutyl cellulose, methyl cellulose, etc. As noted above, the amount of cellulose derivative used is at least 0.2 wt. % of the subbing layer, up to about 1.0 wt. %.

The subbing layer of the invention may be employed at any concentration which is effective for the intended purpose. In general, good results have been obtained at a coverage of from about 0.005 to about 0.5 g/m$^2$ of the element, preferably from about 0.05 to about 0.3 g/m$^2$.

The support for the dye image-receiving elements of the invention may comprise a polyolefin monolayer, or may comprise a polyolefin layer coated on a substrate. In a preferred embodiment of the invention, a paper substrate having thereon a polyolefin layer such as polypropylene is used. In a further preferred embodiment, a paper substrate having thereon a mixture of polypropylene and polyethylene is used. Such substrates are described more fully in U.S. Pat. No. 4,999,335, the disclosure of which is hereby incorporated by reference. The polyolefin layer on the paper substrate is generally applied at about 10 to about 100 g/m$^2$, preferably about 20 to about 50 g/m$^2$. Synthetic supports having a polyolefin layer may also be used. Preferably, the polyolefin layer of the substrate is subjected to a corona discharge treatment prior to being coated with the subbing layer of the invention.

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657, the disclosure of which is incorporated by reference.

Dye-donor elements that are used with the dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to further illustrate the invention.

EXAMPLE

A control subbing layer coating solution was prepared by mixing an aminofunctional organo-oxysilane Prosil 221® with a hydrophobic organo-oxysilane, Prosil 2210®, which is an epoxy-terminated organo-oxysilane, along with a black dye and a brown dye in the amounts as shown in Table 1 below. Subbing layer solutions according to the invention were prepared by adding various amounts of a cellulose derivative to the control solution. Each solution contained approximately 1% of silane component, 20% water, and 79% ethanol.

Dye-receiving elements were prepared containing the above subbing layer coatings between the support and dye-receiving layer to test the effect on uniformity. The support consisted of a paper stock from a blend of Pontiac Maple 51 (a bleached maple hardwood kraft of 0.5 μm length weighted average fiber length) available from Consolidated Pontiac, Inc.) and Alpha Hardwood Sulfite (a bleached red-alder hardwood sulfite pulp of 0.69 μm average fiber length) available from Weyerhauser Paper Co. This support had a microvoided packaging film of OPPalyte® 350 TWK, polypropylene-laminated paper support with a lightly $TiO_2$-pigmented polypropylene skin (Mobil Chemical Co.) at a dry coverage of 0.11 g/m$^2$, 36 μm thick, d=0.62, laminated on the imaging side with the sample formulations coated over the packaging film. Prior to coating, the support was subjected to a corona discharge treatment at approximately 450 joules/m$^2$.

Each subbing layer test sample was overcoated with a dye-receiving layer containing Makrolon® KL3-1013 polyether-modified bisphenol-A polycarbonate block copolymer (Bayer AG) (1.83 g/m$^2$), GE Lexan® 141-112 bisphenol-A polycarbonate (General Electric Co.) (1.61 g/m$^2$), Fluorad FC-431 ® perfluorinated alkylsulfonamidoalkyl ester surfactant (3M Co.) (0.011 g/m$^2$), di-n-butyl phthalate (0.33 g/m$^2$), and diphenyl phthalate (0.33 g/m$^2$) coated from methylene chloride.

The dye-receiving layer was then overcoated with a solvent mixture of methylene chloride and trichloroethylene; a polycarbonate random terpolymer of bisphenol A (50 mole %), diethylene glycol (49 mole %), and polydimethylsiloxane (1 mole %), (2500 MW) block units (0.22 g/m$^2$); Fluorad FC-431® surfactant (0.017 g/m$^2$); and DC-510 surfactant (Dow-Corning Corp.)(0.0083 g/m$^2$).

TABLE 1

| Sample | Subbing Layer Components (coated from ethanol/water mixture) | Dry Coverage (g/m$^2$) |
|---|---|---|
| Control | Prosil 2210 ® (PCR, Inc.) | 0.05 |
| | Prosil 221 ® (PCR, Inc.) | 0.05 |
| | Benzo Black A250 | 0.00484 |
| | Eastone Brown 2R ® | 0.00108 |
| E-1 | Prosil 2210 ® | 0.05 |
| | Prosil 221 ® | 0.05 |
| | Benzo Black A250 | 0.00484 |
| | Eastone Brown 2R ® | 0.00108 |
| | hydroxypropyl cellulose | 0.04 |
| E-2 | Prosil 2210 ® | 0.05 |
| | Prosil 221 ® | 0.05 |
| | Benzo Black A250 | 0.00484 |
| | Eastone Brown 2R ® | 0.00108 |
| | hydroxypropyl cellulose | 0.08 |

L*, a* and b* measurements were then made with a Gretag SPM 50 colorimetry tester on each sample with a black background behind each sample. The following results were obtained:

TABLE 2

| Example | L* | a* | b* |
|---|---|---|---|
| Control | 87.53 | 0.83 | 3.89 |
| E-1 | 87.61 | 0.87 | 3.99 |
| E-2 | 87.00 | 0.64 | 3.66 |
| Contract CNPR | 88.92 | 0.76 | 3.71 |

The above results show that the subbing layer formulations of the present invention have no effect on the colorimetry, i.e., L*, a*, and b*, of the publication grade receiver (control). The colorimetry values of Contract CNPR, a commercially available publication grade proofing paper, are included for comparison only.

Uniformity was assessed by measuring the mottle index of the samples using a Tobias Associates Mottle Tester, Model MTI. The lower the value of the mottle index, the more improved is the visual uniformity. An acceptable value for motile is about 25. The following results were obtained:

TABLE 3

| SAMPLE | MOTTLE INDEX |
|---|---|
| Control | 49 |
| E-1 | 26 |
| E-2 | 14 |
| Contract CNPR | 14 |

The above results show that the coatings of the present invention have greatly improved mottle over the control and approach that of the commercially available publication grade receiver material.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a polyolefin-coated substrate or a polyolefin substrate having thereon, in order, a subbing layer and a dye image-receiving layer, wherein said subbing layer comprises a colored reaction product of a mixture of a) an aminofunctional organo-oxysilane, and b) a hydrophobic organo-oxysilane;

said subbing layer also containing a mixture of brown and black colorants, said brown colorant being present in an amount of about 0.0007 to about 0.015 g/m$^2$ and said black colorant being present in an amount of about 0.004 to about 0.007 g/m$^2$, and the ratio of black to brown colorant being about 3.5:1 to 6.5:1; and said subbing layer also containing at least 0.2 wt. % of a water-soluble, cellulose derivative.

2. The dye-receiving element of claim 1 wherein said support is a polypropylene-coated substrate or polypropylene.

3. The dye-receiving element of claim 1 wherein said dye image-receiving layer contains a thermally-transferred dye image.

4. The dye-receiving element of claim 1 wherein the ratio of the two silanes is 1:1.

5. The dye-receiving element of claim 1 wherein said subbing layer is coated at a coverage of from about 0.005 to about 0.5 g/m$^2$.

6. The dye-receiving element of claim 1 wherein said aminofunctional organo-oxysilane has the following structure:

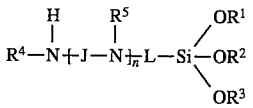

wherein $R^1$, $R^2$ and $R^3$ each independently represents an alkyl group having from one to about 10 carbon atoms, an aryl group having from about 5 to about 10 carbon atoms, or a carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms; and n is 0 or a positive integer up to 6.

7. The dye-receiving element of claim 1 wherein said hydrophobic organo-oxysilane has the formula:

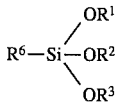

wherein $R^1$, $R^2$ and $R^3$ each independently represents an alkyl group having from one to about 10 carbon atoms, an aryl group having from about 5 to about 10 carbon atoms, or a carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

8. The element of claim 1 wherein said brown colorant is a dye.

9. The element of claim 8 wherein said brown dye is

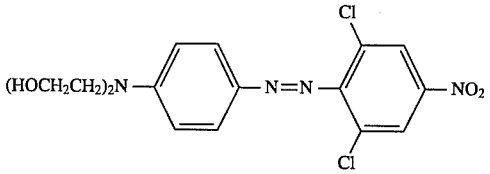

10. The element of claim 1 wherein said black colorant is a dye.

11. The element of claim 10 wherein said black dye is

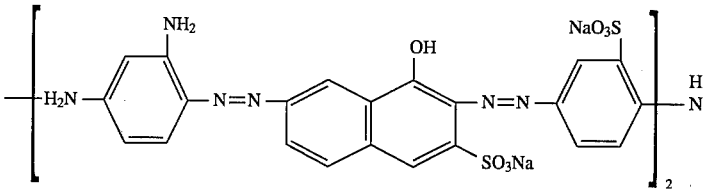

12. The element of claim 1 wherein said water-soluble, cellulose derivative is hydroxypropyl cellulose, hydroxypropyl methyl cellulose, hydroxybutyl cellulose or methyl cellulose.

13. A process of forming a dye transfer image comprising:

I) imagewise-heating a dye-donor element comprising a support having thereon a dye layer comprising a dye dispersed in a binder, and II) transferring a dye image to a dye-receiving element comprising a support having thereon a dye image-receiving layer to form said dye transfer image, wherein said receiving element comprises a polyolefin-coated support or a polyolefin support having thereon, in order, a subbing layer and a dye image-receiving layer, wherein said subbing layer comprises a colored reaction product of a mixture of a) an aminofunctional organo-oxysilane, and b) a hydrophobic organo-oxysilane;

said subbing layer also containing a mixture of brown and black colorants, said brown colorant being present in an amount of about 0.0007 to about 0.015 g/m$^2$ and said black colorant being present in an amount of about 0.004 to about 0.007 g/m$^2$, and the ratio of black to brown colorant being about 3.5:1 to 6.5:1; and said subbing layer also containing at least 0.2 wt. % of a water-soluble, cellulose derivative.

14. The process of claim 13 wherein said aminofunctional organo-oxysilane has the following structure:

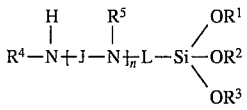

wherein $R^1$, $R^2$ and $R^3$ each independently represents an alkyl group having from one to about 10 carbon atoms, an aryl group having from about 5 to about 10 carbon atoms, or a carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms; and n is 0 or a positive integer up to 6.

15. The process of claim 13 wherein said hydrophobic organo-oxysilane has the formula:

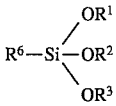

wherein $R^1$, $R^2$ and $R^3$ each independently represents an alkyl group having from one to about 10 carbon atoms, an aryl group having from about 5 to about 10 carbon atoms, or a carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

16. The process of claim 13 wherein said water-soluble, cellulose derivative is hydroxypropyl cellulose, hydroxypropyl methyl cellulose, hydroxybutyl cellulose or methyl cellulose.

17. A thermal dye transfer assemblage comprising:

I) a dye-donor element comprising a support having thereon a dye layer comprising a dye dispersed in a binder, and II) a dye-receiving element comprising a support having thereon a dye image-receiving layer, said dye-receiving element being in a superposed relationship with said dye-donor element so that said dye layer is in contact with said dye image-receiving layer, wherein said receiving element comprises a polyolefin-coated support or a polyolefin support having thereon, in order, a subbing layer and a dye image-receiving layer, wherein said subbing layer comprises a colored reaction product of a mixture of a) an aminofunctional organo-oxysilane, and b) a hydrophobic organo-oxysilane;

said subbing layer also containing a mixture of brown and black colorants, said brown colorant being present in an amount of about 0.0007 to about 0.015 g/m$^2$ and said black colorant being present in an amount of about 0.004 to about 0.007 g/m$^2$, and the ratio of black to brown colorant being about 3.5:1 to 6.5:1; and said subbing layer also containing at least 0.2 wt. % of a water-soluble, cellulose derivative.

18. The assemblage of claim 17 wherein said aminofunctional organo-oxysilane has the following structure:

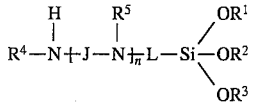

wherein $R^1$, $R^2$ and $R^3$ each independently represents an alkyl group having from one to about 10 carbon atoms, an aryl group having from about 5 to about 10 carbon atoms, or a carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms; and n is 0 or a positive integer up to 6.

19. The assemblage of claim 17 wherein said hydrophobic organo-oxysilane has the formula:

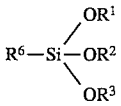

wherein $R^1$, $R^2$ and $R^3$ each independently represents an alkyl group having from one to about 10 carbon atoms, an aryl group having from about 5 to about 10 carbon atoms, or a carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

20. The assemblage of claim 17 wherein said water-soluble, cellulose derivative is hydroxypropyl cellulose, hydroxypropyl methyl cellulose, hydroxybutyl cellulose or methyl cellulose.

* * * * *